US005898755A

United States Patent [19]

Meusel et al.

[11] Patent Number: 5,898,755

[45] Date of Patent: Apr. 27, 1999

[54] X-RAY TUBE

[75] Inventors: Marion Meusel; Roland Schmidt; Guenter Ries, all of Erlangen, Germany

[73] Assignee: Siemens Aktiengesellschaft, Munich, Germany

[21] Appl. No.: 08/955,257

[22] Filed: Oct. 21, 1997

[30] Foreign Application Priority Data

Oct. 31, 1996 [DE] Germany ..... 196 45 053

[51] Int. Cl.[6] ..... H01J 35/30

[52] U.S. Cl. ..... 378/137; 378/138

[58] Field of Search ..... 378/136, 137, 378/138, 121, 119, 113

[56] References Cited

U.S. PATENT DOCUMENTS

| | | | |
|---|---|---|---|
| 3,679,927 | 7/1972 | Kirkendall | 378/137 |
| 3,710,072 | 1/1973 | Shrader et al. . | |
| 5,038,044 | 8/1991 | Wegmann et al. . | |
| 5,111,494 | 5/1992 | Turner et al. | 378/137 X |
| 5,504,791 | 4/1996 | Hell et al. | 378/137 X |
| 5,550,889 | 8/1996 | Gard et al. . | |

FOREIGN PATENT DOCUMENTS 0 460 421 5/1991 European Pat. Off. .

OTHER PUBLICATIONS

"Elektronenstahl–Technologie," Schiller et al., (1977), pp. 89–95.

*Primary Examiner*—David P. Porta
*Attorney, Agent, or Firm*—Hill & Simpson

[57] ABSTRACT

An X-ray tube has a cathode and an anode arranged in a vacuum housing, the electron beam emanating from the cathode proceeding through a hollow cylindrical housing part of the vacuum housing to the anode. An electromagnet is provided for the deflection of the electron beam. The electromagnet has a U-shaped yoke with two legs having first ends connected to one another by a base section and having a winding surrounding the base section. The legs straddle the housing part and the electromagnet is disposed so that the electron beam is spaced a distance from the second ends of the legs so that from the second ends of the legs so that the electron beam is situated only in the stray field of the electromagnet, rather than in the region of maximum field strength.

27 Claims, 2 Drawing Sheets

X-RAY TUBE

BACKGROUND OF THE INVENTION

1. Field of the Invention

The present invention is directed to an X-ray tube of the type having a cathode and an anode arranged in a vacuum housing, the electron beam emanating from the cathode being incident in a focal spot on the anode at which X-rays are produced, with means for deflecting the electron beam being provided.

2. Description of the Prior Art

The possibility of deflecting the electron beam, and thus the focal spot, is of significance, particularly in conjunction with computed tomography, since an improvement in the image quality can be achieved by the known measure of displacing the focal spot between two limit positions, thereby doubling the data available for the calculation of the image of a body slice.

European Application 0 460 421 discloses an X-ray tube of the type initially described, wherein the means for deflecting the electron beam are formed by a curved deflection coil surrounding a hollow cylindrical housing part, which connects the portion of the housing in which the cathode is disposed to the portion of the housing in which the anode is disposed. A problem arises given this X-ray tube that the deflection coil effects not only a deflection but also a defocusing of the electron beam. As a consequence of activation of the deflection coil, thus, the focal spot which arises on the incident surface of the anode at the point struck by the electron beam exhibits not only a displacement on the incident surface but also an undesired change in size and/or shape.

SUMMARY OF THE INVENTION

An object of the present invention is to provide an X-ray tube of the type initially described wherein the defocusing phenomena occurring in the deflection of the electron beam are at least reduced.

According to the invention, this object is achieved by an X-ray tube with a cathode and an anode that are arranged in a vacuum housing, whereby the electron beam emanating from the cathode being incident in a focal spot on the anode, with an electromagnet provided for deflection of the electron beam, the electromagnet having a U-shaped yoke with two leg sections having first ends connected to one another by a base section, with a winding that surrounding the base section, and the electron beam passing between the two legs, and wherein a straight (imaginary) line connecting the second ends of the legs exhibits a spacing from the electron beam, which causes the electron beam to pass only through a stray field generated by the electromagnet, rather than through the region of maximum field strength.

Since the electron beam does not proceed in the region of the second ends of the legs, the electron beam is not located in the region of maximum field strength but instead is located in the region of the stray field that, however, is very uniform between the legs at a spacing from their ends. This represents the basic pre-condition for avoiding defocusing phenomena and also offers the advantage that the deflection of the electron beam can be very precisely influenced by varying the intensity of the current flowing through the winding of the electromagnet. In order to assure that the electron beam is located outside the region of maximum field strength, and thus in the region of the stray field, the spacing of the electron beam from the second ends of the legs should at least equal the spacing between the legs. If the sections of the legs located in the region of the electron beam proceed parallel to one another from the yoke, the magnetic field of the electromagnet is symmetrical relative to the plane containing the middle axes of the parallel sections of the legs of the yoke. The result is that defocusing phenomena that occur, despite the high uniformity of the magnetic field located between the legs, when the electron beam passes through the part of the magnetic field located at one side of this plane on its path through the hollow cylindrical housing part are at least partially cancelled in turn when the electron beam passes through the part of the magnetic field lying at the other side of the plane.

The defocusing phenomena occurring on the path of the electron beam through the part of the magnetic field located at the one side of said plane are in turn eliminated on the path of the electron beam through the part of the magnetic field located at the other side of this plane to an especially high degree when the main propagation direction of the electron beam proceeds substantially at a right angle to the plane containing the middle axes of the two parallel sections of the legs of the yoke.

Defocusing phenomena that my still remain can be minimized by arranging the electromagnet such that a straight line that intersects the middle axes of the parallel sections of the legs at a right angle, and also intersects the main propagation direction of the electron beam, intersects the two parallel sections of the legs substantially at half their length. Alternatively, a reduction of defocusing phenomena that may still remain can be achieved when the electromagnet is arranged such that the electron beam intersects a straight line which intersects the middle axes of the parallel sections of the legs at a right angle this line intersecting the main propagation direction of the electron beam substantially in the middle. In both instances, the electron beam assumes a course (in view of the symmetry of the magnetic field) relative to the plane containing the middle axes of the two parallel sections of the legs of the yoke, that assures, under a wide range of conditions, that the defocusing phenomena occurring on the path of the electron beam through the part of the magnetic field located at the one side of said plane are in turn eliminated on the path of the electron beam through the part of the magnetic field located at the other side of said plane.

The phrase "main propagation direction of the electron beam" mentioned above means the direction exhibited by the electron beam at the point it passes through the plane containing the middle axes of the two parallel sections of the legs of the yoke, when the electron beam assumes a middle position lying between the two limit positions that can be achieved by the deflection of the electron beam.

In order to assure that a uniform magnetic field having an adequate extent is present, in an embodiment of the invention the length of the parallel sections of the legs is longer than the greatest extent of the hollow cylindrical housing part in the direction of the middle axes of the parallel sections of the legs.

A further advantage is that, in the invention, the parallel sections of the legs of the yoke are located close to the electron beam to be deflected, so that the power which must be supplied to the winding in order to effect a specific deflection of the electron beam is low and the electromagnet is small and inexpensive. Especially beneficial conditions are produced when, in an embodiment of the invention, the cross-section of the hollow cylindrical housing part does not significantly exceed the size required for an unimpeded passage of the electron beam.

DESCRIPTION OF THE PREFERRED EMBODIMENTS

Figure 1:
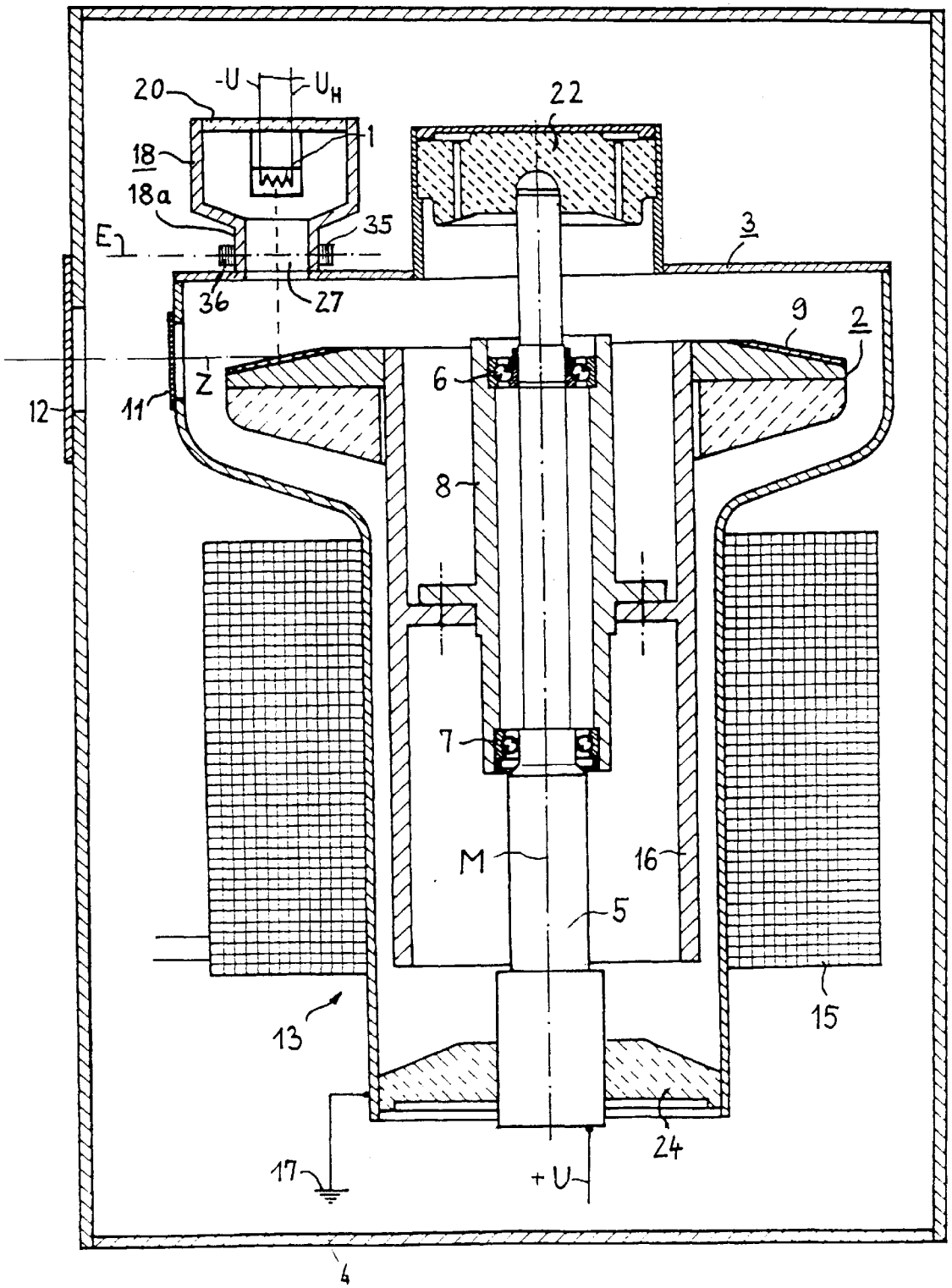
FIG. 1 shows an inventive X-ray tube schematically in longitudinal section.

The X-ray tube of FIG. 1 has a stationary cathode 1 and a rotating anode 2 that are arranged in a vacuum-tight, evacuated vacuum housing 3 that is in turn accepted in a protective housing 4 filled with an electrically insulating, fluid coolant, for example insulating oil. The rotating anode 2 is rotatably seated on a stationary axis 5 in the vacuum housing 3, with two rolling bearings 6 and 7 and a bearing sleeve 8.

The rotating anode 2, which is fashioned rotationally-symmetrical relative to the middle axis M of the shaft 5, has an incident surface 9 provided, for example, with a layer of a tungsten-rhenium alloy onto which an electron beam 10 emanating from the cathode I is incident for generating X-rays. (In FIGS. 1 and 3, only the middle axis of the electron beam 10 is shown, with broken lines.) The corresponding useful ray beam (only the central ray Z thereof is shown in FIG. 1) emerges through beam exit windows 11 and 12 that are provided in the vacuum housing 3 and the protective housing 4 and are arranged in alignment with one another.

An electric motor 13 fashioned as squirrel-cage induction motor is provided for driving the rotating anode 2, the motor 13 including a stator 15 placed on the vacuum housing 3 and a rotor 16 that is located inside the vacuum housing 3 and torsionally connected to the rotating anode 2.

A funnel-shaped housing section 18, which is connected to the rest of the vacuum housing 3 via a hollow cylindrical housing part 18*a*, is attached to the vacuum housing 3 that is at ground potential 17 and is formed of metallic material, except for an insulator 20 carrying the cathode 1 and two insulators 22 and 24 that accept the shaft 5. The cathode 1 is attached to the funnel-shaped housing section 18 via the insulator 20. The cathode 1 is thus situated in a special chamber of the vacuum housing 3 that is connected thereto via the hollow cylindrical housing part 18*a*.

The shaft 5 is at a positive high-voltage +U for the rotating anode 2. The shaft 5 is accepted vacuum-tight in the insulator 22. The tube current thus flows via the rolling bearings 6 and 7.

As can be seen from the schematic illustration of FIG. 1, a negative high-voltage −U is at one terminal of the cathode 1. The filament voltage $U_H$ is across the terminals of the cathode 1. The lines leading to the cathode 1, the shaft 5, the vacuum housing 3 and the stator 15 are connected in a known way to a voltage supply (not shown) located outside the protective housing 4 that supplies the voltages required for the operation of the X-ray tube. As is clear from the above comments that the X-ray tube of FIG. 1 of the type known as a two-pole tube.

As can be seen from FIG. 1, the electron beam 10 emanating from the cathode 1 proceeds through the housing part 18*a* to the rotating anode 2. The housing part 18*a* thus limits a diaphragm opening 27. The dimensions thereof are selected such that they do not significantly exceed the dimensions required for an unimpeded passage of the electron beam 10.

At least the funnel-shaped housing part 18 and the upper wall of the vacuum housing 3 in FIG. 1 (but preferably all metallic parts of the vacuum housing 3) are formed of non-magnetic materials, for example stainless steel. The housing part 18 and the upper wall of the housing 3 thus limit a radially outwardly open annular space located outside the vacuum housing 3 in which an electromagnet 31 schematically indicated in FIG. 1 is arranged. The electromagnet 31 generates a magnetic deflection field that acts on the electron beam 10 and deflects it perpendicularly to the plane of the drawing of FIG. 1.

The electromagnet 31 has a U-shaped yoke 33 having two legs 35 and 36 connected to one another via a base section 34. A winding 37 surrounds the base section 34. The electromagnet 31 is arranged such that the housing part 18*a* is located between the two legs 35 and 36 of the yoke 33. These legs 35 and 36 lie against the housing part 18*a*.

The winding 37 of the electromagnet 31 has terminals $I_S$ connected to a current source (not shown) that allows a current to flow through the winding 37 during operation of the X-ray tube. If the current flowing through the winding is 37 a direct current, the electron beam 10 is statically deflected, so that the static position of the focal spot can be adjusted. Given, for example, employment of the X-ray tube in a computed tomography apparatus, it is thus possible to adjust the position of the focal spot relative to the rotational center of the gantry of the computed tomography apparatus and relative to the radiation detector that is attached to the gantry and lies opposite the X-ray tube. If a periodic deflection of the electron beam 10 is desired, the current supplied from the deflection circuit has a saw-tooth or delta curve.

The yoke 33, is constructed of thin sheet metal lamellae in a known way employed for yoke construction in general. The yoke 33 is shaped such that the legs 35 and 36 have respective sections 35*a* and 36*a* whose respective middle axes $M_1$ and $M_2$ proceed substantially parallel to one another and thus lie in a common plane E. In the described exemplary embodiment, the two straight-line sections 35*a* and 36*a* of the legs 35 and 36 exhibit a length L that is longer than the largest extent of the housing part 18*a* in the direction of the middle axes $M_1$ and $M_2$ of the sections 35*a* and 36*a* of the legs 35 and 36. As is known from general magnetic yoke technology, in order to avoid deteriorations of the magnetization properties the sheet metal lamellae must be annealed after their processing (cutting and bending) in order to in turn cancel structural changes caused by the processing.

Figure 2:
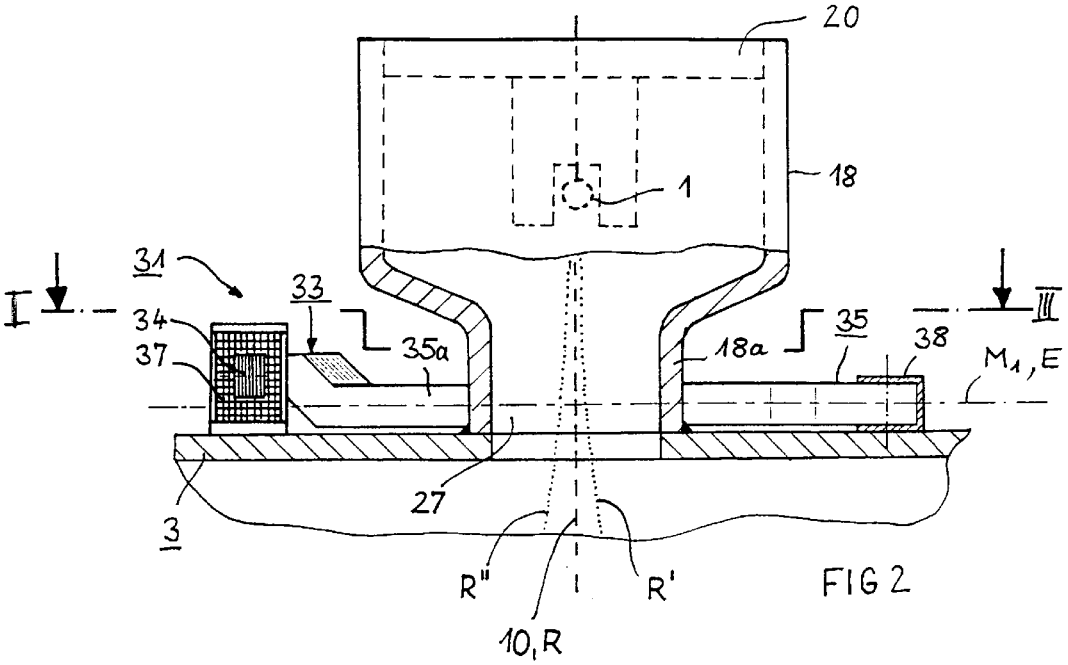
FIG. 2 is a partial view of a section along the line II—II in FIG. 3.
Figure 3:
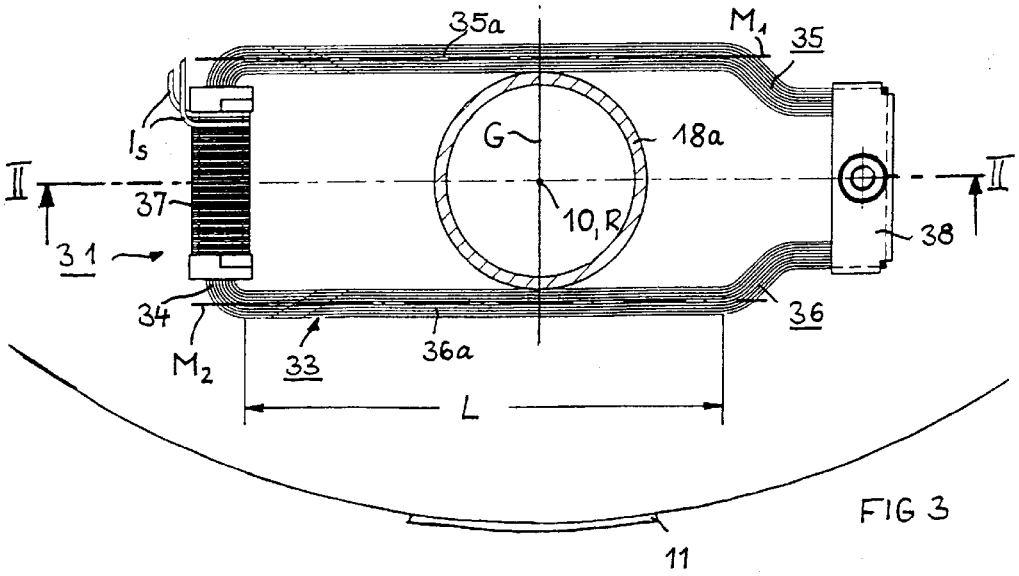
FIG. 3 partial view of a section along the line III—III in FIG. 2.

The electromagnet 31 is attached to the vacuum housing 350 that the main propagation direction (shown with broken lines) of the electron beam 10 proceeds at substantially at a right angle to the plane E containing the middle axes of the sections 35*a* and 36*a* of the legs 35 and 36, as can be seen from FIG. 1 in combination with FIGS. 2 and 3. The respective courses R' and R" of the electron beam for the two limit positions that can be achieved by the deflection of the electron beam are shown dotted in FIG. 3.

Further, the electromagnet 31 is arranged such that the electron beam 10 intersects a straight line G substantially in the middle. This straight line G intersects the main propagation direction of the electron beam 10 and the middle axes $M_1$ and $M_2$ of the sections 35*a* and 36*a* of the legs 35 and 36 substantially at a right angle. As can be seen from FIGS. 2 and 3, the electron beam 10 thus exhibits a spacing from the ends of the legs 35 and 36 that is larger than the spacing between the sections 35*a* and 36*a* of the legs 35 and 36 located in the region of the electron beam 10.

The electron beam 10 thus is not situated in the region of maximum field strength, which is present in the region of the ends of the legs 35 and 36, but instead is situated in the region of the stray field of the electromagnet 31. This stray field, however, is very uniform between the legs 35 and 36 at the spacing from the ends, this being the basic precondition for avoiding defocusing phenomena.

As a result of the described fashioning and arrangement of the electromagnet 31, the magnetic field thereof is symmetrical relative to the plane E containing the sections 35*a* and 36*a* of the legs 35 and 36. This and the described arrangement of the electromagnet 31 relative to the vacuum housing 3 result in defocusing phenomena, that occur when the electron beam passes through that part of the magnetic field located at the one side of the plane E on its path through the housing part 18*a*, being substantially completely cancelled in turn when the electron beam passes through that part of the magnetic field lying at the other side of the plane E.

The described arrangement of the electromagnet 31 also allows the legs 35 and 36 of the yoke 33 to be located very close to the electron beam 10, and thus only low power is required for deflection of the electron beam 10. Moreover, the dissipated power of the electromagnet 31 can be unproblemmatically transferred to coolant situated in the protective housing 4.

The electromagnet 31, moreover, is very compact and can be very easily fixed to the vacuum housing 3, for example with a clamp part 38 screwed to the vacuum housing 3.

The legs 35 and 36 of the yoke 33, further, are angled toward one another in the region of their free ends in order to avoid an unnecessarily large stray field.

Of course, the magnitude of the deflection of the electron beam 10 with the electromagnet 31 is taken into consideration in the dimensioning of the housing part 18*a*, and thus the dimensioning of the diaphragm opening 27.

Since the vacuum housing 3 lies at ground potential, and thus a more positive potential than the cathode 1, a large part of the electrons back-scattered from the rotating anode 2 is captured by the regions of the vacuum housing 3 which limit the diaphragm opening 27 and adjoining the opening 27. Apart from its function of containing components, thus, the vacuum housing 3 serves as a diaphragm for the reduction of extra-focal radiation, particularly in the region of the housing part 18*a*.

Since, except for a small region wherein the legs 35 and 36 of the yoke 33 lie against the exterior of the housing part 18*a*, the housing part 18*a* that limits or forms the diaphragm opening 27 is directly in contact with coolant situated in the protective housing 4, a good cooling is assured, so that thermal problems do not occur.

The X-ray tube shown in FIG. 1 is what is of a type known as a two-pole X-ray tube. The inventive X-ray tube, however, can also be implemented as a one-pole X-ray tube. The vacuum housing 3 and the rotating anode 2 then are at the same potential, namely ground potential, whereas the negative high-voltage –U is at the cathode 1. In order to place both the rotating anode 2 and the vacuum housing 3 at ground potential, an end plate formed of an electrically conductive material can, for example, be provided instead of the insulator 22 and/or the insulator 24, so that there is an electrically conductive connection between the rotating anode 2 and the vacuum housing 3. Alternatively or additionally, the shaft 5 can be connected to ground potential 17.

In the described exemplary embodiment, the electromagnet 31 is located entirely outside the vacuum housing 3. It is also possible to arrange the electromagnet 31 entirely or partly within the vacuum housing 3, but the winding 37 is preferably located outside the vacuum housing 3 in this instance.

Although the invention has been explained only on the basis of an X-ray tube with a rotating anode, it can also be employed in X-ray tubes having a fixed anode.

Although modifications and changes may be suggested by those skilled in the art, it is the intention of the inventors to embody within the patent warranted hereon all changes and modifications as reasonably and properly come within the scope of their contribution to the art.

We claim as our invention:

1. An X-ray tube comprising:

an evacuated housing;

a cathode and an anode disposed in said housing, said cathode emitting an electron beam which strikes said anode at a focal spot, thereby causing X-rays to be generated at said focal spot;

an electromagnet adjacent a housing region of said evacuated housing to interact with and deflect said electron beam, said electromagnet having a U-shaped yoke with two legs connected by a base section, said base section having a winding thereon connected to a current source, said legs straddling said electron beam, said electromagnet generating a magnetic field having a region of maximum field strength and a stray field region, and said legs being disposed relative to said electron beam so that said electron beam is situated in said stray field region and not in said region of maximum field strength; and said evacuated housing comprising metallic parts and said metallic parts, at least in said housing region, being composed of non-magnetic metal.

2. An X-ray tube as claimed in claim 1 wherein each of said legs has a first end connected to said base section and a straight section connected to said first end and terminating at a second end, and wherein said legs are disposed relative to said electron beam so that a straight line connecting the respective second ends of said legs is disposed at distance preceding from said electron beam than is said base section.

3. An X-ray tube as claimed in claim 2 wherein said straight sections have a spacing therebetween, and wherein said distance between said electron beam and said straight line is at least equal to said spacing.

4. An X-ray tube as claimed in claim 2 wherein the respective straight sections of said legs are parallel to each other.

5. An X-ray tube as claimed in claim 4 wherein each of said straight sections has a middle axis and wherein said electron beam has a main propagation direction, and wherein the middle axes of said straight sections are disposed in a common plane through which said main propagation direction of said electron beam proceeds substantially at a right angle.

6. An X-ray tube as claimed in claim 4 wherein said legs are disposed relative to said X-ray beam so that said main propagation direction of said electron beam intersects a middle of a further straight line, said further straight line intersecting said middle axes of said straight sections substantially at respective right angles.

7. An X-ray tube as claimed in claim 1 wherein said housing has a first section in which said cathode is disposed and a second section in which said anode is disposed and a hollow, shaft-shaped housing section connecting said first and second sections, and wherein said electromagnet is disposed surrounding an exterior of said shaft-shaped housing section.

8. An X-ray tube as claimed in claim 7 wherein said shaft-shaped housing section has a largest exterior dimension, and wherein each of said legs of said electromagnet has a straight section which is longer than said largest exterior dimension of said shaft-shaped housing section.

9. An X-ray tube as claimed in claim 7 wherein said shaft-shaped housing section has an interior cross-section which does not exceed a minimum size necessary for unimpeded passage of said electron beam through said shaft-shaped housing section.

10. An X-ray tube as claimed in claim 2 wherein said straight line is closer to said electron beam than is said base section.

11. An X-ray tube comprising:

an evacuated housing;

a cathode and an anode disposed in said housing, said cathode emitting an electron beam which strikes said anode at a focal spot, thereby causing X-rays to be generated at said focal spot; and an electromagnet disposed to interact with and deflect said electron beam, said electromagnet having a U-shaped yoke with two legs connected by a base section, said base section having a winding thereon connected to a current source, said legs straddling said electron beam, said electromagnet generating a magnetic field having a region of maximum field strength and a stray field region, and said legs being disposed relative to said electron beam so that said electron beam is situated in said stray field region and not in said region of maximum field strength, each of said legs having a first end connected to said base section and a straight section connected to said first end and terminating at a second end, and said legs being disposed relative to said electron beam so that a straight line connecting the respective second ends of said legs is disposed at a different distance from said electron beam than is said base section.

12. An X-ray tube as claimed in claim 11 wherein said straight sections have a spacing therebetween, and wherein said distance between said electron beam and said straight line is at least equal to said spacing.

13. An X-ray tube as claimed in claim 11 wherein the respective straight sections of said legs are parallel to each other.

14. An X-ray tube as claimed in claim 13 wherein each of said straight sections has a middle axis and wherein said electron beam has a main propagation direction, and wherein the middle axes of said straight sections are disposed in a common plane through which said main propagation direction of said electron beam proceeds substantially at a right angle.

15. An X-ray tube as claimed in claim 13 wherein said legs are disposed relative to said X-ray beam so that said main propagation direction of said electron beam intersects a middle of a further straight line, said further straight line intersecting said middle axes of said straight sections substantially at respective right angles.

16. An X-ray tube as claimed in claim 11 wherein said housing has a first section in which said cathode is disposed and a second section in which said anode is disposed and a hollow, shaft-shaped housing section connecting said first and second sections, and wherein said electromagnet is disposed surrounding an exterior of said shaft-shaped housing section.

17. An X-ray tube as claimed in claim 16 wherein said shaft-shaped housing section has a largest exterior dimension, and wherein each of said legs of said electromagnet has a straight section which is longer than said largest exterior dimension of said shaft-shaped housing section.

18. An X-ray tube as claimed in claim 16 wherein said shaft-shaped housing section has an interior cross-section which does not exceed a minimum size necessary for unimpeded passage of said electron beam through said shaft-shaped housing section.

19. An X-ray tube as claimed in claim 11 wherein said straight line is closer to said electron beam than is said base section.

20. An X-ray tube comprising:

an evacuated housing having a first section and a second section connected by a hollow, shaft-shaped housing section;

a cathode disposed in said first section of said housing and an anode disposed in said second section of said housing, said cathode emitting an electron beam which propagates through said hollow, shaft-shaped housing section and which strikes said anode at a focal spot, thereby causing X-rays to be generated at said focal spot; and an electromagnet disposed surrounding an exterior of said shaft-shaped housing section to interact with and deflect said electron beam, said electromagnet having a U-shaped yoke with two legs connected by a base section, said base section having a winding thereon connected to a current source, said legs straddling said electron beam, said electromagnet generating a magnetic field having a region of maximum field strength and a stray field region, and said legs being disposed relative to said electron beam so that said electron beam is situated in said stray field region and not in said region of maximum field strength, said shaft-shaped housing section having a largest exterior dimension, and each of said legs of said electromagnet having a straight section which is longer than said largest exterior dimension of said shaft-shaped housing section.

21. An X-ray tube as claimed in claim 20 wherein each of said legs has a first end connected to said base section and a straight section connected to said first end and terminating at a second end, and wherein said legs are disposed relative to said electron beam so that a straight line connecting the respective second ends of said legs is disposed at a different distance from said electron beam than is said base section.

22. An X-ray tube as claimed in claim 21 wherein said straight sections have a spacing therebetween, and wherein said distance between said electron beam and said straight line is at least equal to said spacing.

23. An X-ray tube as claimed in claim 21 wherein the respective straight sections of said legs are parallel to each other.

24. An X-ray tube as claimed in claim 23 wherein each of said straight sections has a middle axis and wherein said electron beam has a main propagation direction, and wherein the middle axes of said straight sections are disposed in a common plane through which said main propagation direction of said electron beam proceeds substantially at a right angle.

25. An X-ray tube as claimed in claim 23 wherein said legs are disposed relative to said X-ray beam so that said main propagation direction of said electron beam intersects a middle of a further straight line, said further straight line intersecting said middle axes of said straight sections substantially at respective right angles.

26. An X-ray tube as claimed in claim 21 wherein said straight line is closer to said electron beam than is said base section.

27. An X-ray tube as claimed in claim 20 wherein said shaft-shaped housing section has an interior cross-section which does not exceed a minimum size necessary for unimpeded passage of said electron beam through said shaft-shaped housing section.

* * * * *

UNITED STATES PATENT AND TRADEMARK OFFICE

CERTIFICATE OF CORRECTION

PATENT NO. : 5,898,755

DATED : 4/27/99

INVENTOR(S) : Meusel et al.

It is certified that error appears in the above-identified patent and that said Letters Patent is hereby corrected as shown below:

Column 6, line 42, delete "than is said base section"

Signed and Sealed this

Twenty-fourth Day of August, 1999

*Attest:*

Q. TODD DICKINSON

*Attesting Officer*

*Acting Commissioner of Patents and Trademarks*